United States Patent [19]

Correa et al.

[11] Patent Number: 5,052,854

[45] Date of Patent: Oct. 1, 1991

[54] HIGHWAY GUIDANCE VEHICLE SYSTEMS

[75] Inventors: Manuel Correa; James MacKenzie; Richard Nakamoto, all of San Jose; Lee D. Sutton, San Martin, all of Calif.

[73] Assignee: SFO Enterprises, Santa Clara, Calif.

[21] Appl. No.: 510,985

[22] Filed: Apr. 19, 1990

[51] Int. Cl.[5] ..... E01F 9/08

[52] U.S. Cl. ..... 404/94; 404/72; 180/169

[58] Field of Search ..... 404/72, 94; 180/169; 250/202

[56] References Cited

U.S. PATENT DOCUMENTS

| | | | |
|---|---|---|---|
| 3,550,077 | 12/1970 | Swift | 340/32 |
| 3,953,145 | 4/1976 | Teach | 404/84 |
| 4,219,092 | 8/1980 | Richter | 180/169 |
| 4,376,007 | 3/1983 | Eigenmann | 156/497 |
| 4,700,223 | 10/1987 | Shoutaro et al. | 358/93 |
| 4,701,049 | 10/1987 | Beckmann et al. | 356/1 |
| 4,765,773 | 8/1988 | Hopkins | 404/94 |
| 4,781,465 | 11/1988 | Demachi et al. | 356/4 |
| 4,786,815 | 11/1988 | Walker et al. | 250/560 |
| 4,802,788 | 2/1989 | Smith | 404/94 |
| 4,918,607 | 4/1990 | Wible | 180/169 X |

FOREIGN PATENT DOCUMENTS

| | | | |
|---|---|---|---|
| 1658568 | 3/1970 | Fed. Rep. of Germany | 404/94 |
| 2609068 | 7/1988 | France | 404/94 |
| 44182 | 4/1979 | Japan | 404/94 |
| 48802 | 2/1988 | U.S.S.R. | 404/94 |

*Primary Examiner*—William P. Neuder

*Attorney, Agent, or Firm*—Limbach, Limbach & Sutton

[57] ABSTRACT

A striping system for a roadway having a reference element. The striping system has means for traveling along the roadway, means mounted on the traveling means for applying a stripe to the roadway, and means adjustably mounted on the traveling means for shining a light beam against the reference element. The traveling means are steered along the roadway to maintain the light beam shining means on the reference element during travel along said roadway. The stripe applying means are positioned on the roadway to apply a stripe where desired in parallel to the reference element.

5 Claims, 4 Drawing Sheets

HIGHWAY GUIDANCE VEHICLE SYSTEMS

BACKGROUND

1. Field of the Invention

The present invention relates to controlling the movement of a vehicle travelling along a roadway, more specifically to a method for applying stripes and lane markers to road surfaces.

2. Discussion of the Prior Art

Lane marking or striping of road surfaces is conventionally done by dispatching a survey party onto a roadway to place small marks or "cat-tracks" on the roadway. At some later time, another crew returns to paint strips or lane markers using the cat-tracks as a guide.

The vehicles that paint the lanes are frequently equipped with a mechanical boom or pointer device extending from the front of the vehicle to help the driver guide the vehicle along the cat-tracks. The boom is difficult to align along the cat tracks, as the distance between boom and driver is significant. A boom also poses a safety hazard since it extends much further forward than a normal vehicle. For example, upon arrival at an intersection, the boom protrudes into the intersection; this scenario has been the cause of many auto accidents. Further, use of the boom does not always make it possible to guide the vehicle, e.g. at intersections and hilltops.

Survey crews are ordinarily scheduled to maximize their efficiency, thus it may be a long period of time before lane markers are painted by the second crew. This can result in unmarked or ambiguous lane markings, thus increasing the potential for unsafe vehicle operation on the roadway.

The use of low power lasers to provide highly focused, visible red light is well known. Such laser beams are directional and controllable and their brilliance makes them ideal for visual optimizing. For instance, when a laser device is used to generate and cast a visible line of light along or across a log, a board, or plywood, the light is narrow and of even brightness for the entire line length. Such a line enables the sawyer to make a more accurate cut than is possible with traditional, incandescent, shadow-line based sawing equipment.

Laser beams have also been used as control systems for earthworking machines, as disclosed in Teach, U.S. Pat. No. 3,953,145. In Teach, a laser beam is periodically swept across the working area, and used in coordination with a mechanical tape machine to maintain the earthworker at a desired grade or elevation.

SUMMARY OF THE INVENTION

It is an object of the present invention to provide a device which accurately and reliably applies lane markers and striping to road surfaces.

It is a further objective of the present invention to increase the maneuverability of lane striping machines.

It is another objective of the present invention to provide increased safety conditions for drivers during a roadway striping operation.

It is another objective of the present invention to eliminate the unsafe driving conditions caused by the absence of lane markers or striping during the time between placement of the cat-tracks and the actual striping or restriping of the roadway.

It is still another object of the present invention to provide a guidance system that can easily be mounted on an existing paint striping vehicle to improve the guidance of the vehicle and permit use of the vehicle without the necessity for cat-tracks.

These and other objectives and advantages are achieved by providing a striping system for a roadway having a reference element, wherein the striping system has means for traveling along the roadway, means mounted on the traveling means for applying a stripe to the roadway, and means adjustably mounted on the traveling means for shining a light beam against the reference element. The traveling means are steered along the roadway to maintain light beam shining means on the reference element during travel along the roadway. The stripe applying means are positioned on the roadway to apply a stripe where desired in parallel to the reference element.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
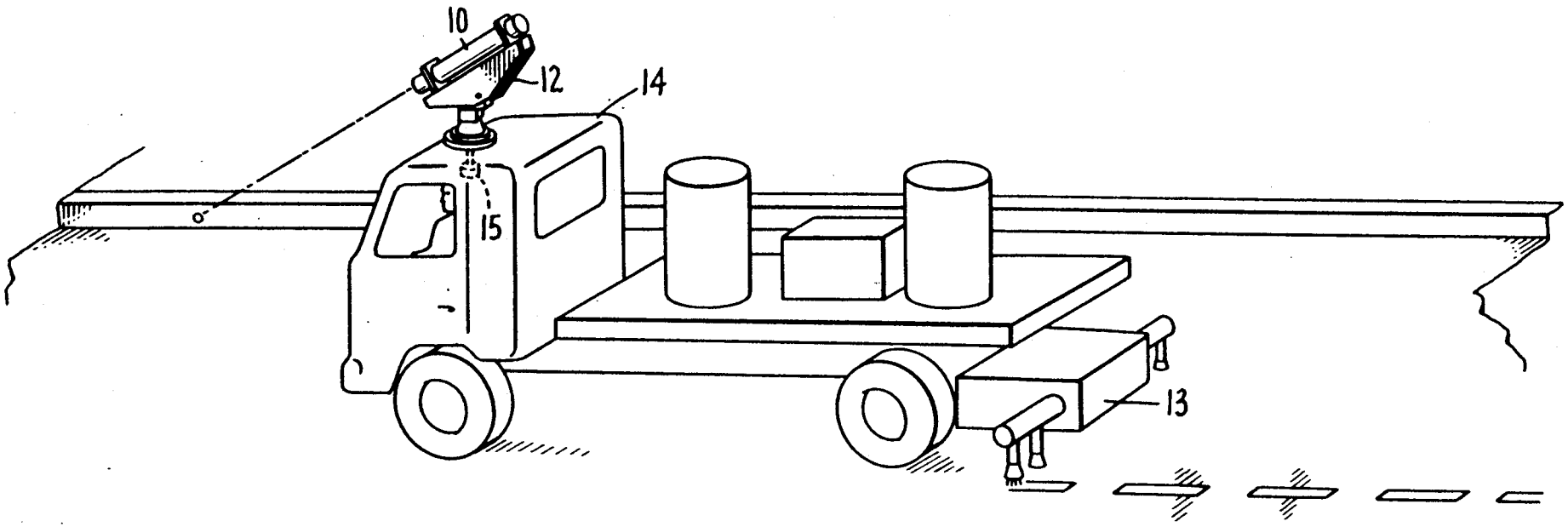
FIG. 1 is a side elevational view of a vehicle equipped with a guidance system in accordance with the present invention.

Referring now to FIG. 1, the paint striping system according to the present invention is illustrated. A low-power laser 10 is secured to a swivel mount 12 which is mounted on the cab of truck 14, such that the driver of the vehicle has adjustment controls 15 which allow him to alter vertical or horizontal positioning of the laser beam from inside of the cab. A conventional stripe painting assembly 13 is mounted on the truck 14.

Figure 2A:
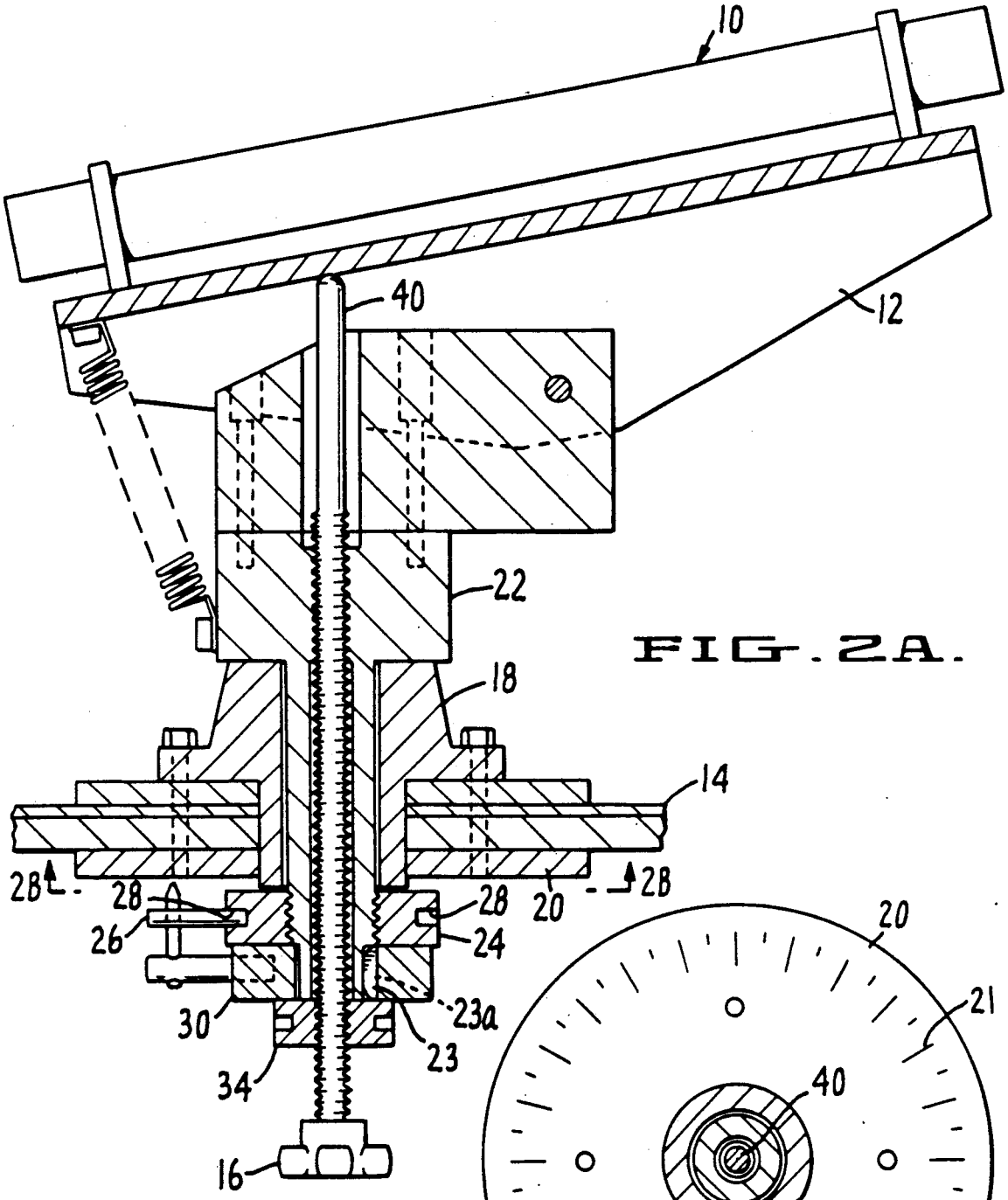
FIG. 2*a* is an elevational sectional view of a portion of the structure shown in FIG. 1 illustrating the mounting of the guidance system in accordance with the present invention.
Figure 2B:
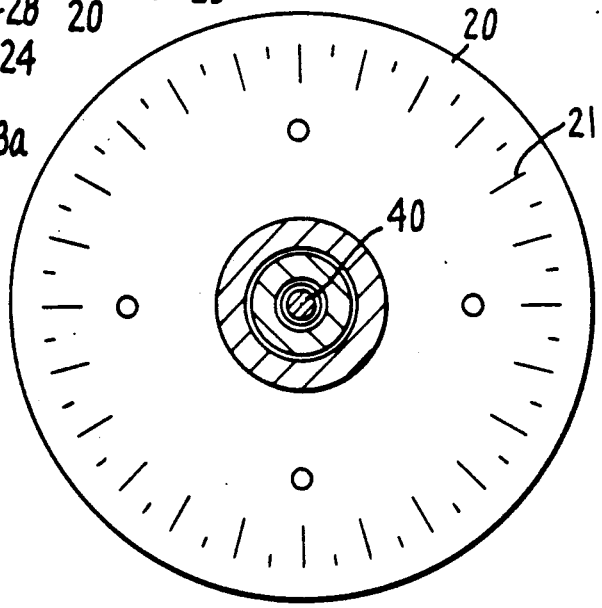
FIG. 2*b* is a sectional view of the structure shown in FIG. 2*a* taken along line 2*b* in the direction of the arrows.

Referring now to FIGS. 2*a* and 2*b*, a more detailed description of the preferred cab mounting is illustrated. A flange 18 is bolted through the cab roof 14 to index ring 20. Index ring 20 has calibration markings 21 as shown in FIG. 2*b*. The zero mark on index ring 20 should be aligned so that it faces directly to the rear of the vehicle. Next, the swivel mount support 22 is slipped through the flange 18, cab 14, and index ring 20. A friction ring 24 is then threaded onto swivel mount support 22. A peg 26 can be inserted in holes 28 in the friction ring 24 to facilitate easy movement of the friction ring. Next, a winder ring 30 is slipped onto the swivel mount support 22 and held in place by key 23 in keyway 23*a*. The laser 10 and swivel mount 12 can then be rotated to the desired horizontal position by turning the winder ring 30 and locked in position by tightening friction ring 24 against index ring 20. A locking nut 34 threads onto the swivel mount height control shaft 40 to lock the laser 10 at a desired vertical orientation. Finally, a winder knob 16 threads onto the swivel mount height control shaft 40 located centrally within the swivel mount support 22 to give the operator height control of the swivel mount assembly 12 and laser 10.

Figure 3A:
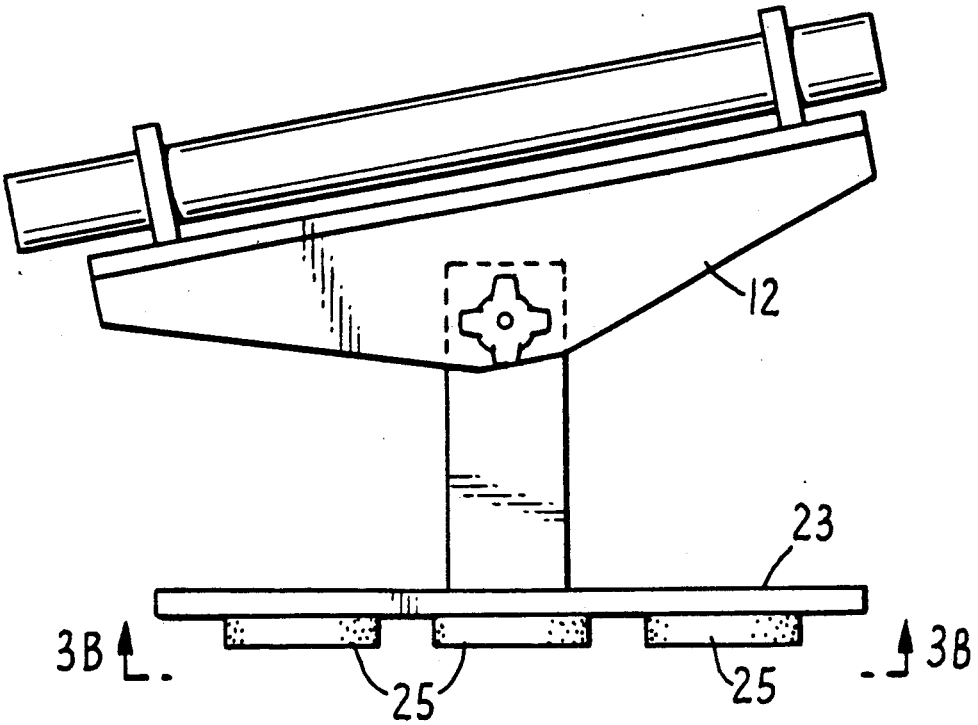
FIGS. 3*a* and 3*b* are views similar to FIGS. 2*a* and 2*b* and illustrate an alternative mounting of the guidance system according to the present invention.
Figure 3B:
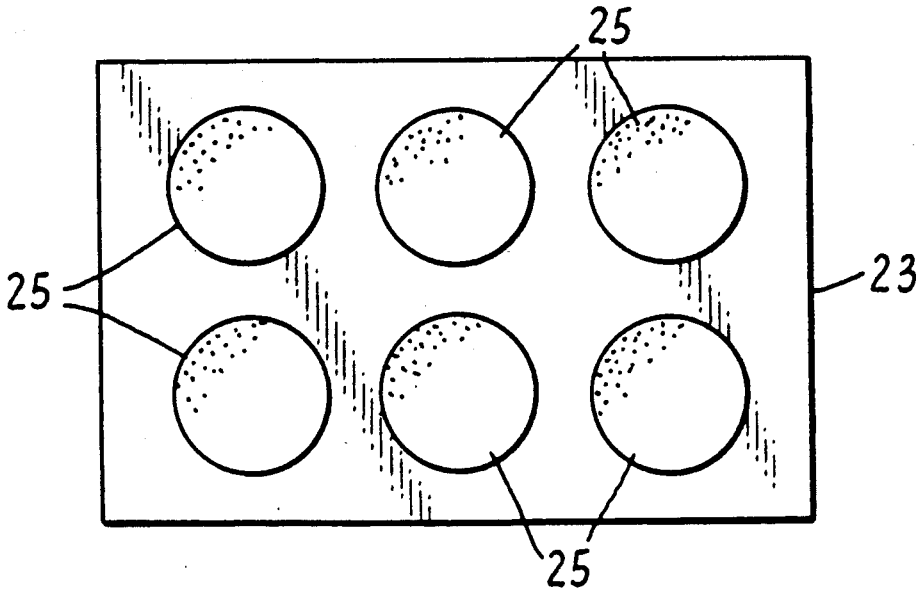

In the alternative embodiment of FIGS. 3*a* and 3*b*, the swivel mount 12 is attached to a base 23 which may be removably attached to truck 14 by magnets 25 or similar portable-type fastening.

The laser 10 is preferably a low-power unit having a helium-neon, argon, or other common visible light emitting radiation source which generates 15 to 50 milliwatts of output power, but may generate as little as 1 milliwatt, or as much as 100 milliwatts of output power. Voltage requirements are typically 115 VAC and can be supplied through a converter from the vehicle's 12 VDC battery by simply plugging into the vehicle's cigarette lighter, for example.

Figure 4A:
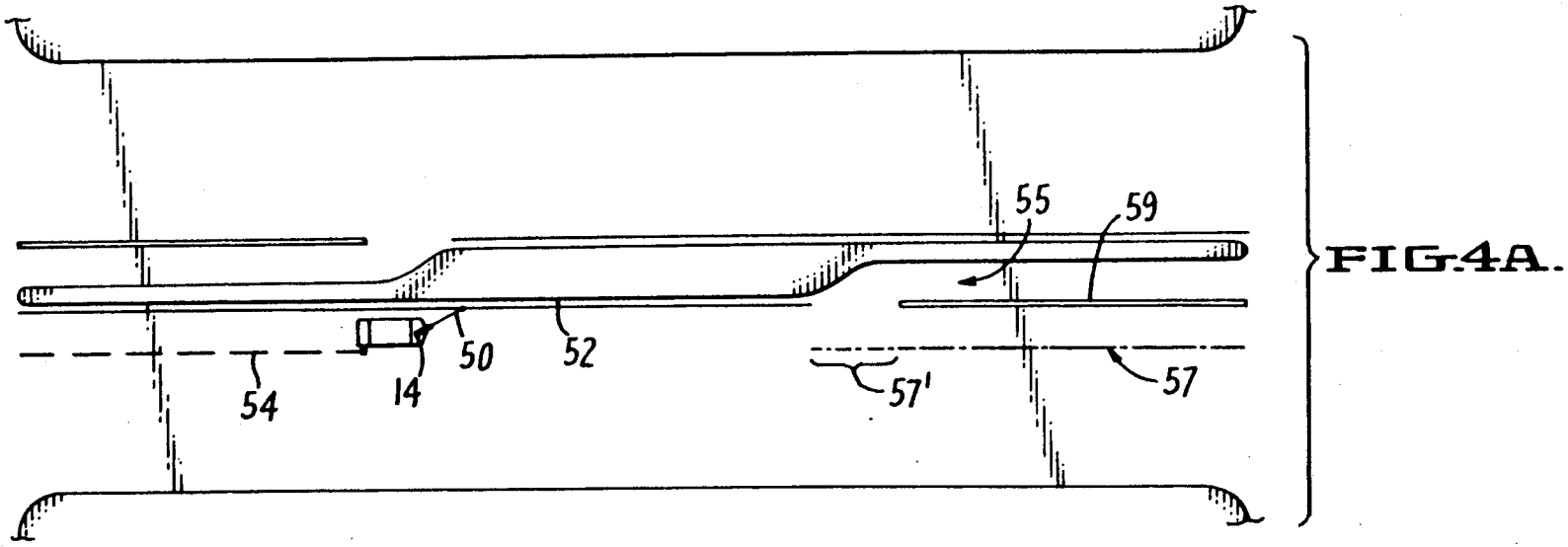
FIGS. 4*a* and 4*b* illustrate the application of striping to a roadway in accordance with the present invention.
Figure 4B:
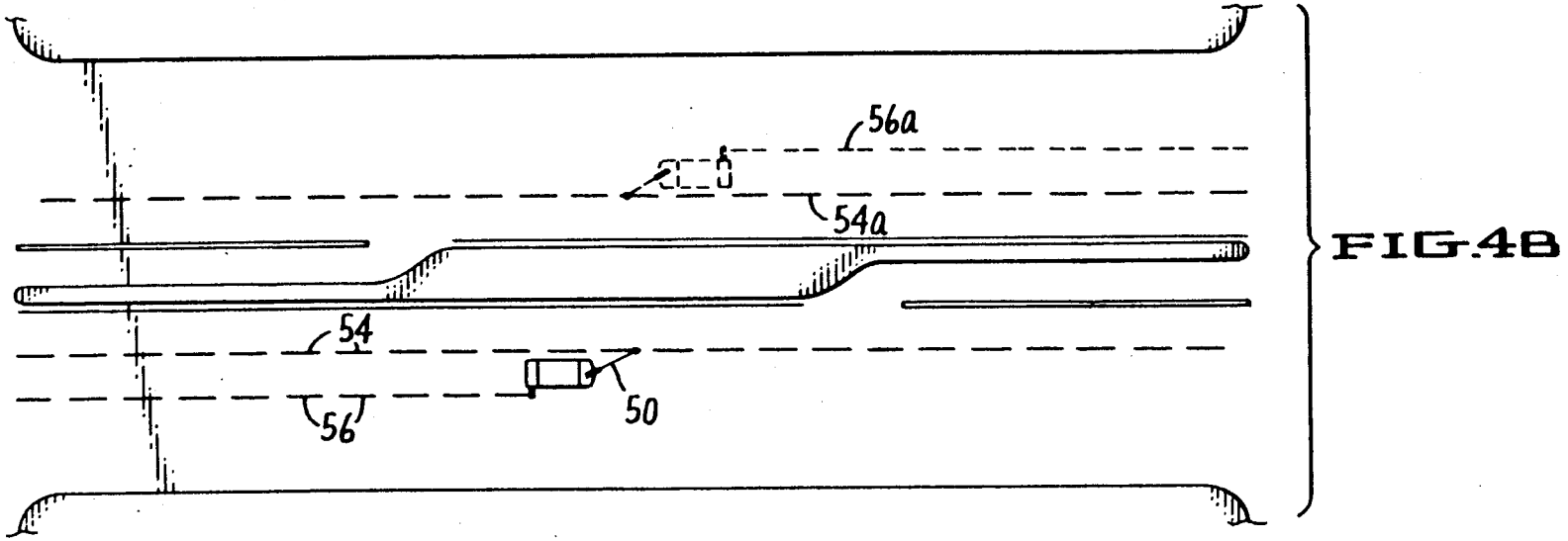

Referring now to FIGS. 4*a* and 4*b*, a typical roadway is shown. Vehicle 14 travels along the roadway directing a beam 50 from the laser unit (not shown) onto curb 52 which operates as a reference point for the laser. A conventional road stripe painting assembly (refer to FIG. 1) attached to vehicle 14 is engaged to apply a first set of lane markers 54 parallel to the curb reference 52.

The lane striping vehicle 14 can travel and stripe any desired length of roadway. If the relationship of the reference element or curb 52 to the desired position of the stripe changes, such as where the curb moves closer to the center of the road, such as at left turn lane 55, some short cat-tracks 57 may be required. Even the length of this cat-track 57 may be limited to just the length 57' if a first pass is made by the vehicle 14 to paint a left turn lane stripe 59 where an extension of the curb 52 would fall so that when referencing on the curb 52 to lay down stripe 54, the vehicle can follow the cat-track 57' at the beginning of the left turn lane 55 and then pick up the lane stripe 59 as a reference.

The vehicle can then return in the opposite direction to stripe the other side of the roadway with a stripe 54*a* (as shown in FIG. 4*b*) corresponding to the stripe 54.

After completing the first set of lane markers 54 and 54*a*, the vehicle 14 makes its next pass using the first set of lane markers 54 and 54*a* as a reference upon which to direct laser beam 50. A second set of lane markers 56 and 56*a* are thus painted in parallel with the reference lane markers 54 and 54*a*. Additional lanes or stripes may be applied in a similar manner. There is no limitation on the types of reference which may be used, including curbs, lane markers, edge of roadbed, guardrail, etc.

The calibration marking 21 on the index ring 20 can be designed in number of feet so that with the swivel mount 12 rotated by operation of winder knob 16 to a specific footage index, the paint stripe will be applied by striping equipment 13 at the selected footage distance from the reference element, such as curb 52, as long as the vehicle is steered to maintain the light beam on the curb 52 as the vehicle 14 travels along the roadway. There may be different sates of calibration markings when a particular vehicle has different sets of painting assemblies 13.

It should be understood that the invention is not intended to be limited by the specifics of the above-described embodiment, but rather defined by the accompanying claims.

We claim:

1. A system for guiding a vehicle along a roadway, said system comprising a light beam adjustably attached to said vehicle, wherein said light beam is directed against a frame of reference which parallels the roadway, and wherein the terminal position of said light beam is observed on said frame of reference when said vehicle is located at the desired position on the roadway, and wherein said vehicle is operated to travel along the roadway and maintain the terminal position of the light beam on the frame of reference.

2. A striping system for a roadway having a frame of reference which parallels the roadway, comprising:

(a) means for traveling along said roadway;

(b) means mounted on said traveling means for applying a stripe to said roadway; and (c) means adjustably mounted on said traveling means for shining a light beam against said frame of reference when said traveling means is located at the desired position on said roadway to apply a stripe with said stripe applying means, wherein the traveling means is moved down the roadway and steered to maintain the beam on the frame of reference and the stripe is applied lengthwise on the roadway as desired.

3. The system of claim 2, wherein said adjustable mounting for said light beam shining means further comprises index means for calibrated control of the light beam direction in accordance with required striping needs.

4. An improved apparatus for striping a roadway having a frame of reference in parallel with the roadway, wherein a vehicle is adapted to travel along the roadway and an apparatus is mounted on the vehicle for directing paint onto the roadway to from a stripe as the vehicle moves, the improvement comprising:

(a) means mounted on the vehicle for generating a light beam; and (b) means for adjusting the position of said light beam generating means in order to direct the light beam onto a terminal point on the frame of reference when the vehicle is located at the desired position on said roadway to apply a stripe, such that the vehicle is operated to maintain the terminal point of the light beam on the frame of reference and keep the vehicle positioned at the desired distance from the frame of reference element, at which vehicle position a stripe is applied to the roadway.

5. A method for striping roadway surfaces with a vehicle having a paint striping apparatus thereon, wherein the roadway has a frame of reference in parallel thereto, the method comprising the steps of:

(a) directing a light beam onto the frame of reference, such that the vehicle is positioned at a desired distance from the frame of reference;

(b) observing the terminal position of the light beam on the frame of reference;

(c) steering the vehicle to travel lengthwise along the roadway and to maintain the terminal position of the light beam on the frame of reference; and (d) applying a stripe to the roadway.

* * * * *